US011614305B2

(12) United States Patent
Galli et al.

(10) Patent No.: US 11,614,305 B2
(45) **Date of Patent: *Mar. 28, 2023**

(54) PISTOL MOUNTED FLASHLIGHT ASSEMBLY

(71) Applicant: Emissive Energy Corp., North Kingstown, RI (US)

(72) Inventors: Robert D. Galli, North Kingstown, RI (US); Christopher J. O'Brien, North Kingstown, RI (US); Mikhail T. Hyde, North Kingstown, RI (US)

(73) Assignee: Emissive Energy Corp., North Kingstown, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/472,036

(22) Filed: Sep. 10, 2021

(65) Prior Publication Data

US 2021/0404767 A1 Dec. 30, 2021

Related U.S. Application Data

(63) Continuation of application No. 17/012,192, filed on Sep. 4, 2020, now Pat. No. 11,118,864.

(60) Provisional application No. 62/898,425, filed on Sep. 10, 2019.

(51) Int. Cl.

| | |
|---|---|
| ***F41G 1/35*** | (2006.01) |
| ***F41G 11/00*** | (2006.01) |
| *F41C 27/00* | (2006.01) |

(52) U.S. Cl.
CPC ..... *F41G 1/35* (2013.01); *F41G 11/003* (2013.01); *F41C 27/00* (2013.01)

(58) Field of Classification Search
CPC ..... F41G 1/35; F41G 11/003
USPC ..... 42/146
See application file for complete search history.

(56) References Cited

U.S. PATENT DOCUMENTS

| | | | | |
|---|---|---|---|---|
| 10,365,069 | B1 | 7/2019 | Tayon et al. | |
| 11,118,864 | B2 * | 9/2021 | Galli | F41G 11/003 |
| 2002/0100204 | A1 | 8/2002 | Kim | |
| 2006/0196099 | A1 | 9/2006 | Matthews et al. | |
| 2011/0290968 | A1 | 12/2011 | Maughan et al. | |
| 2018/0283670 | A1 | 10/2018 | Galli et al. | |

* cited by examiner

*Primary Examiner* — Reginald S Tillman, Jr.
(74) *Attorney, Agent, or Firm* — Barlow, Josephs & Holmes

(57) ABSTRACT

A flashlight assembly includes an elongated housing, a light assembly received within the front of the housing, a battery door assembly at the rear of the housing, a latch assembly on the top of the housing and a clamp assembly also on the top of the housing. Paddle switches for operating the flashlight are integrated into the battery door assembly at the rear of the housing. The battery door assembly is both slidable and rotatable relative to the main housing.

13 Claims, 9 Drawing Sheets

PISTOL MOUNTED FLASHLIGHT ASSEMBLY

CROSS-REFERENCE TO RELATED APPLICATIONS

This application is Continuation of U.S. application Ser. No. 17/012,192, filed Sep. 4, 2020, which claims the benefit of U.S. Provisional Patent Application No. 62/898,425, filed Sep. 10, 2019, the entire contents of which are incorporated herein by reference.

BACKGROUND OF THE DISCLOSURE

The present invention generally relates to a multi-function pistol mounted flashlight and more specifically to a pistol mounted flashlight having an integrated dovetail rail mounting interface and an improved metal housing construction.

Flashlights of the type contemplated herein are used by law enforcement and military personnel in rugged outdoor conditions which require a high degree of reliability in all weather conditions. There is a continuing need for improved flashlight assemblies that provide better reliability for mounting and operation, better waterproofing and easier battery changes.

SUMMARY OF THE DISCLOSURE

The flashlight assembly generally includes an elongated housing, a light assembly received within the front of the housing, a battery door assembly at the rear of the housing, a latch assembly on the top of the housing and a clamp assembly also on the top of the housing. Paddle switches for operating the flashlight are integrated into the battery door assembly at the rear of the housing.

BRIEF DESCRIPTION OF THE DRAWINGS

Exemplary embodiments will now be described further by way of example with reference to the following examples and figures, which are intended to be illustrative only and in no way limiting upon the scope of the disclosure.

DETAILED DESCRIPTION OF THE EXEMPLARY EMBODIMENTS

Figure 1:
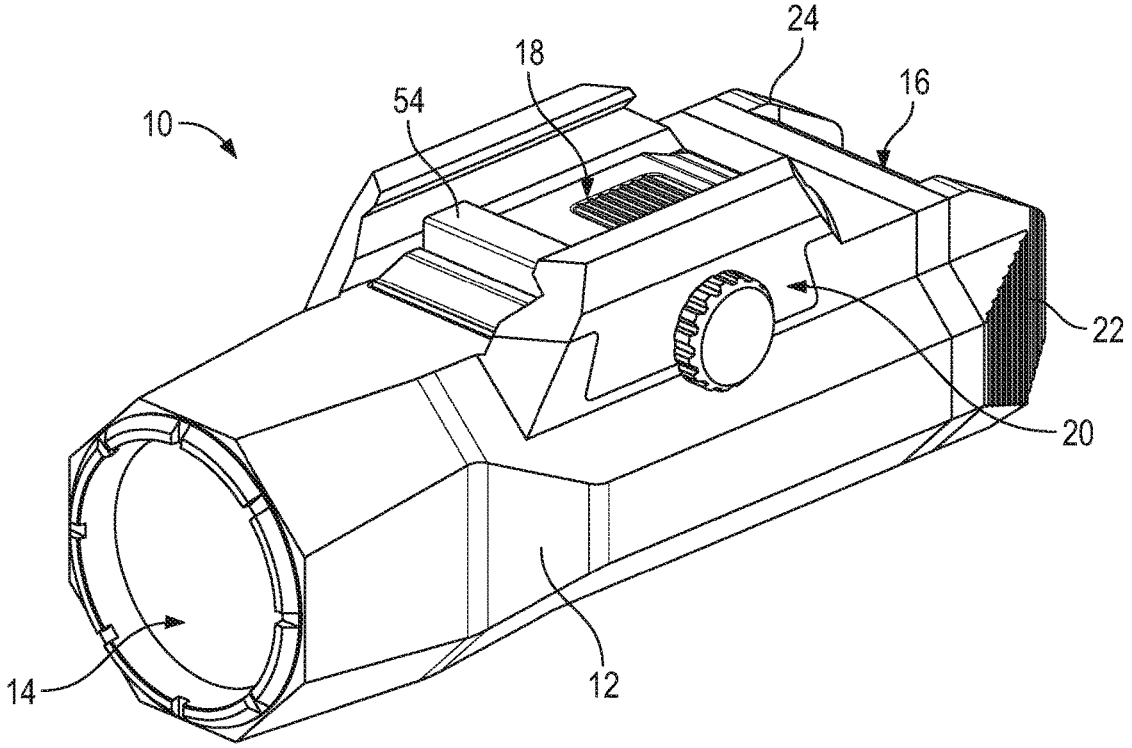
FIG. 1 is a perspective view of an exemplary flashlight assembly in accordance with the present invention.
Figure 2:
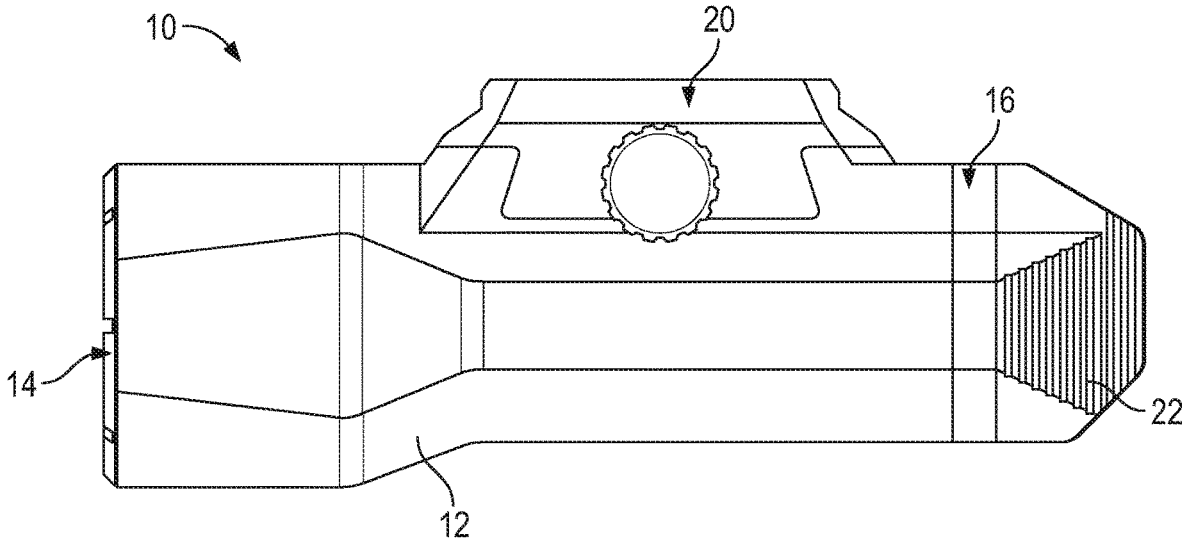
FIG. 2 is a side view thereof.
Figure 3:
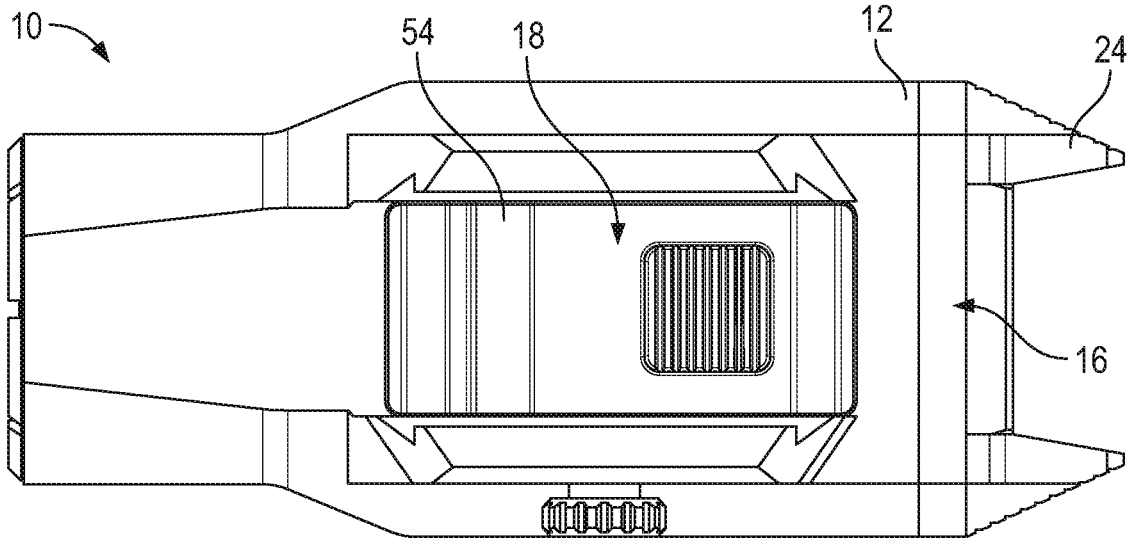
FIG. 3 is a top view thereof.
Figure 4:
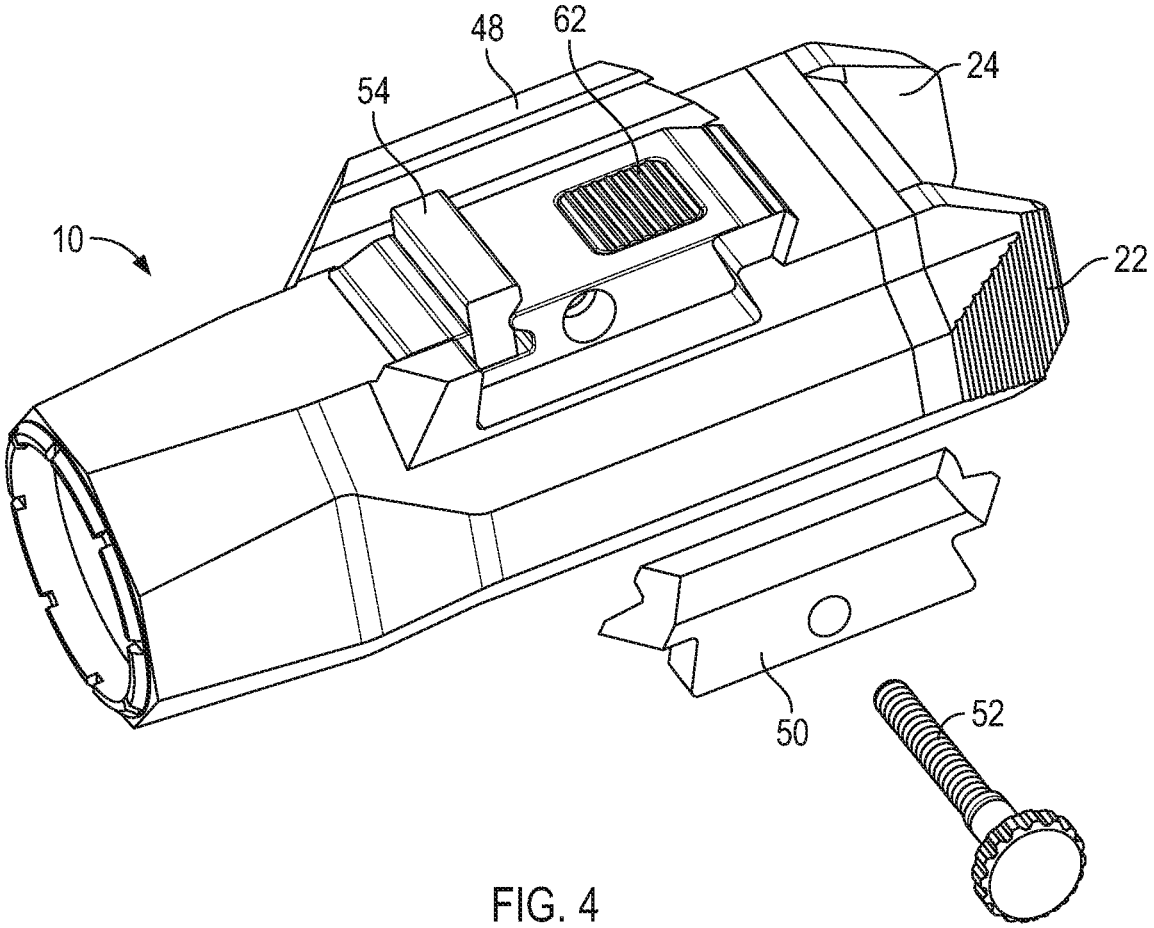
FIG. 4 is a partially exploded perspective view with the clamping bar moved to reveal the crossbar and latch assembly.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Now referring to the drawings, an exemplary embodiment of the present flashlight assembly is shown and generally indicated at 10 in FIGS. 1-12. The flashlight assembly 10 generally includes an elongated housing 12, a light assembly 14 received within the front of the housing 12, a battery door assembly 16 at the rear of the housing 12, a latch assembly 18 on the top of the housing 12 and a clamp assembly 20 also on the top of the housing 12. Paddle switches 22, 24 for operating the flashlight are integrated into the battery door assembly 16 at the rear of the housing.

With the exception of the latch assembly 18, all components of the present flashlight are preferably fashioned from metal for a durable and rugged construction. The all-metal housing 12, clamp 20, battery door 16 and switching paddles 22, 24 provide for an improved and more reliable construction. The latch assembly 18 may also be constructed from metal components, but in the exemplary embodiment, these components are molded from a polymer material.

The housing 12 generally has an opening 26 at the front for receiving the light assembly 14, a recess 28 in the top for receiving the latching assembly 18 and a dual battery compartment opening 30 to the rear. Two side-by-side batteries 32, 34 are received into the compartment 30 for power.

The light assembly 14 comprises a heat sink/reflector body 36 to collect and dissipate the waste heat generated during operation of the flashlight as well as reflect light from an LED 38. The reflector body 36 is inserted into the opening 26 in the front of the housing 12. A retaining ring 40 retains a lens 42 spanning across the opening 26. Adjacent a rear surface of the reflector body 36 is a circuit board 44 that includes the at least one LED 38 positioned thereon. In the exemplary embodiment, the LED 38 is a single visible white LED positioned centrally within the reflector body 36. Optionally, there may be one or more other LEDs (not shown) positioned adjacent the white LED. The LED(s) is/are controlled by a processor and other circuitry on a separate control circuit board 46 positioned rearwardly of the LED circuit board 44.

The clamping assembly 20 includes a fixed clamping arm 48 which is part of the housing 12, a second movable clamping bar 50 and a thumb screw 52 for tightening the movable clamping bar 50. The dovetail clamping assembly 20 allows the flashlight assembly 10 to be mounted onto an integrated dovetail rail which runs along a pistol frame forward of the trigger guard. When mounted, the paddle switches 22, 24 straddle the forward end of the trigger guard and are ergonomically positioned for ambidextrous actuation with the user's trigger finger.

Turning to FIG. 4-7, a removable and reversible cross bar 54 extends across the top of the housing 12 and is received in positioning slots in the pistol dovetail rail to prevent sliding of the flashlight assembly 10 when mounted. The crossbar configuration includes reversible mil-spec and Weaver dimensions and is further described in U.S. Pat. No. 10,352,657, the entire contents of which are incorporated herein by reference. In the exemplary embodiment, the reversible crossbar 54 is integrated as part of the latch assembly 18 which is inserted and retained within the recess 28 in the top of the housing. The latch assembly 18 comprises a housing body 56 with an undercut groove 58 extending laterally across the top and a latch button opening 60 rearward of the crossbar groove 58. The crossbar 54 is slidably received within the undercut groove 58.

Figure 5:
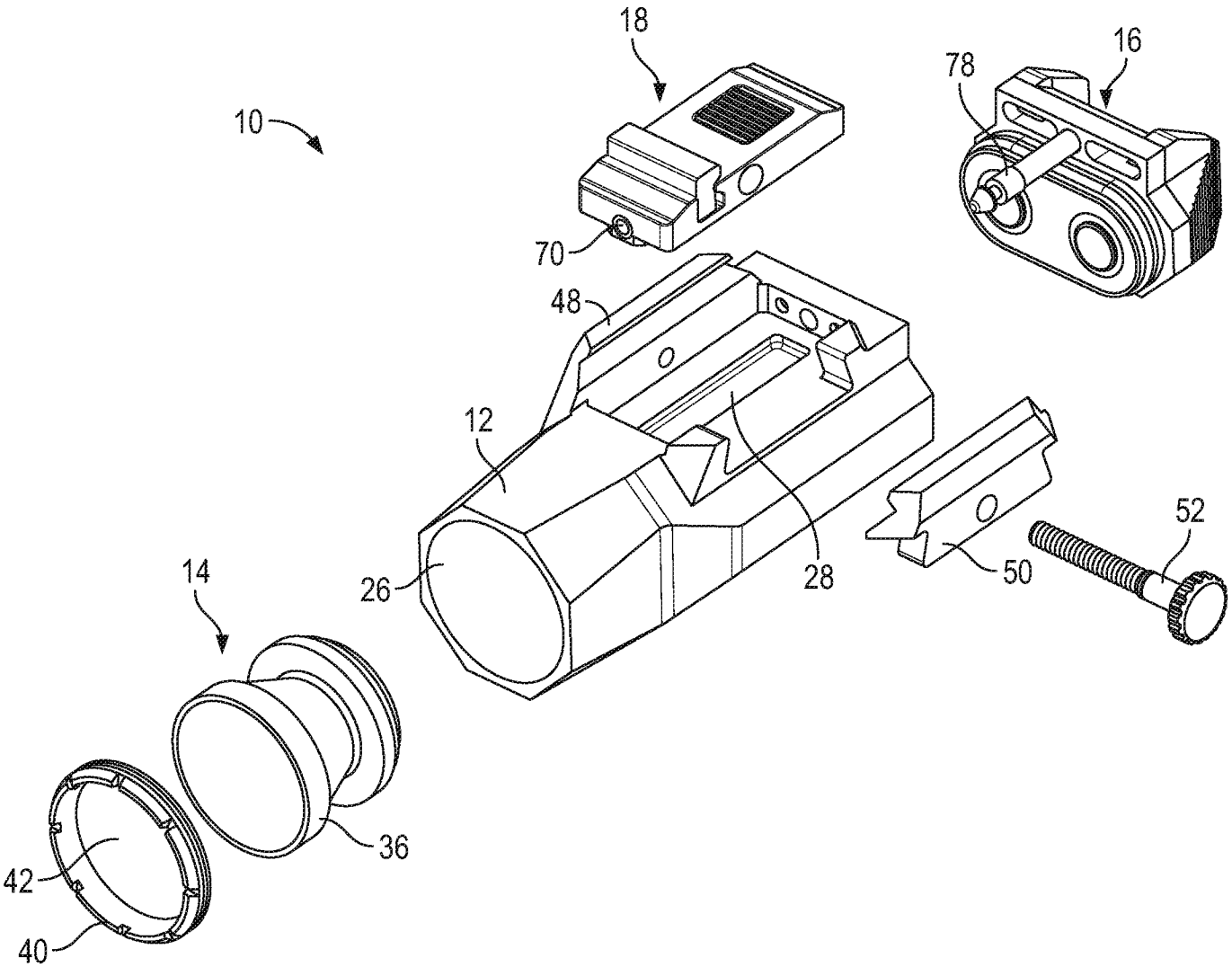
FIG. 5 is an exploded perspective view of the flashlight assembly.
Figure 6:
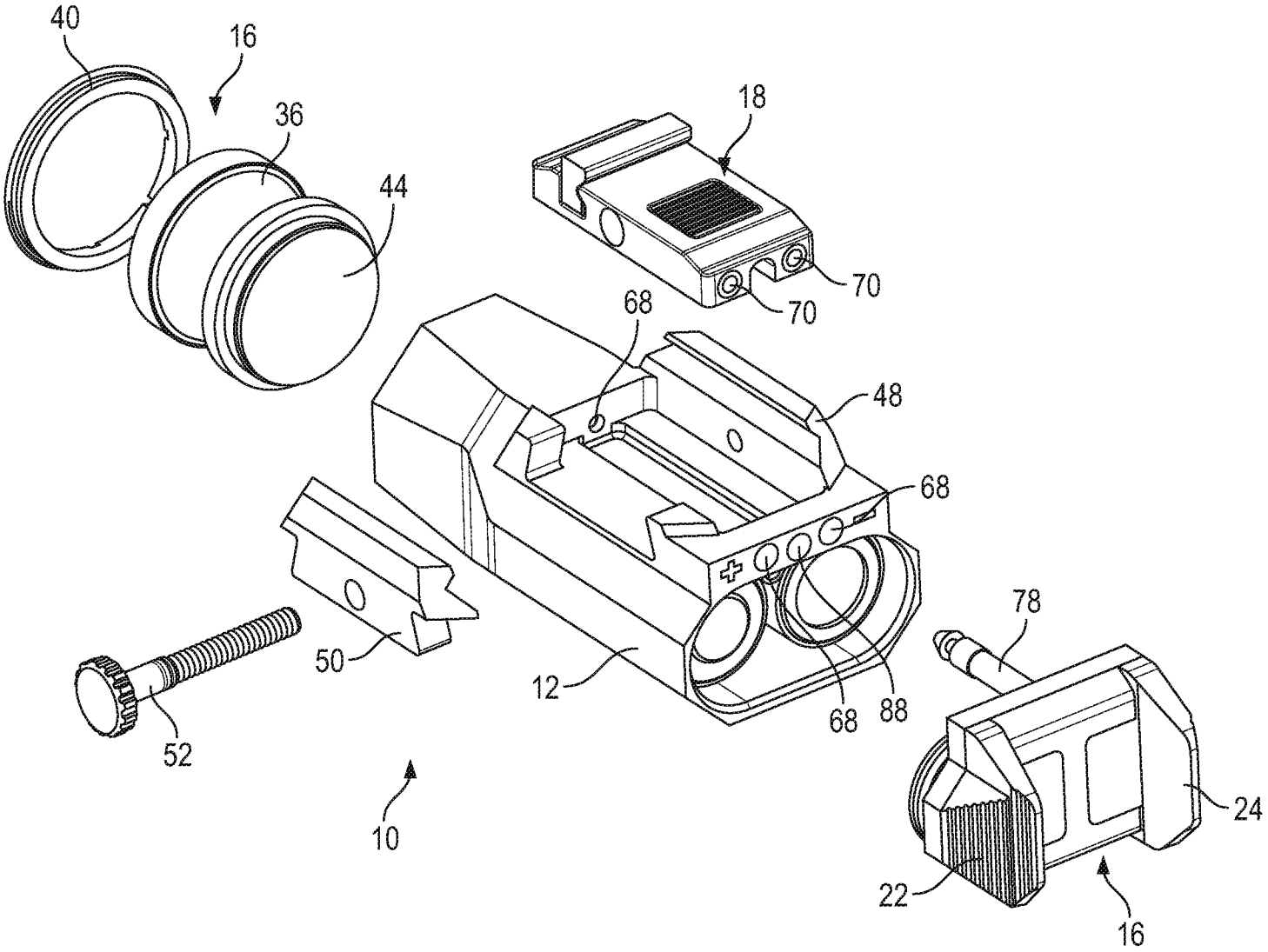
FIG. 6 is another exploded perspective view thereof.
Figure 6A:
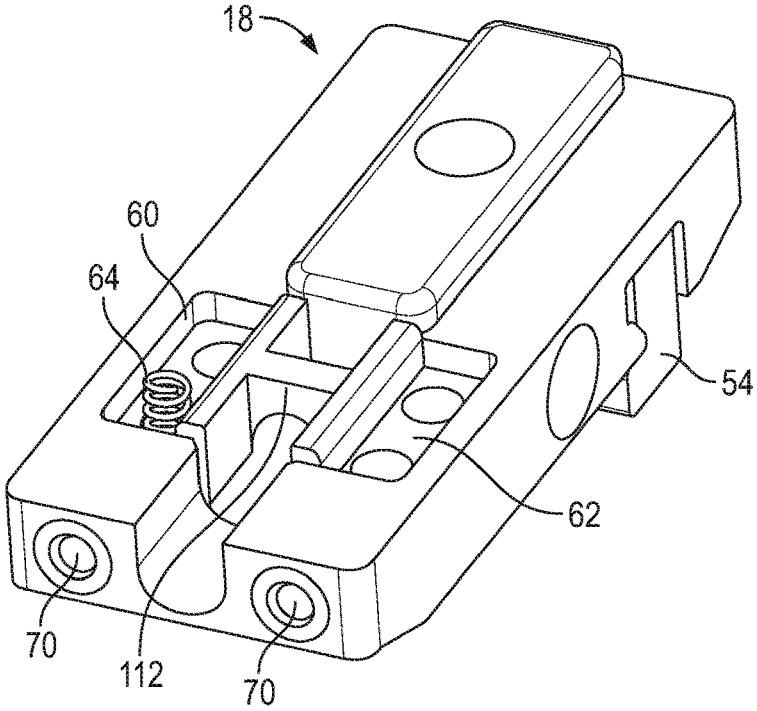
FIG. 6A is a bottom perspective view of the latch assembly.
Figure 7:
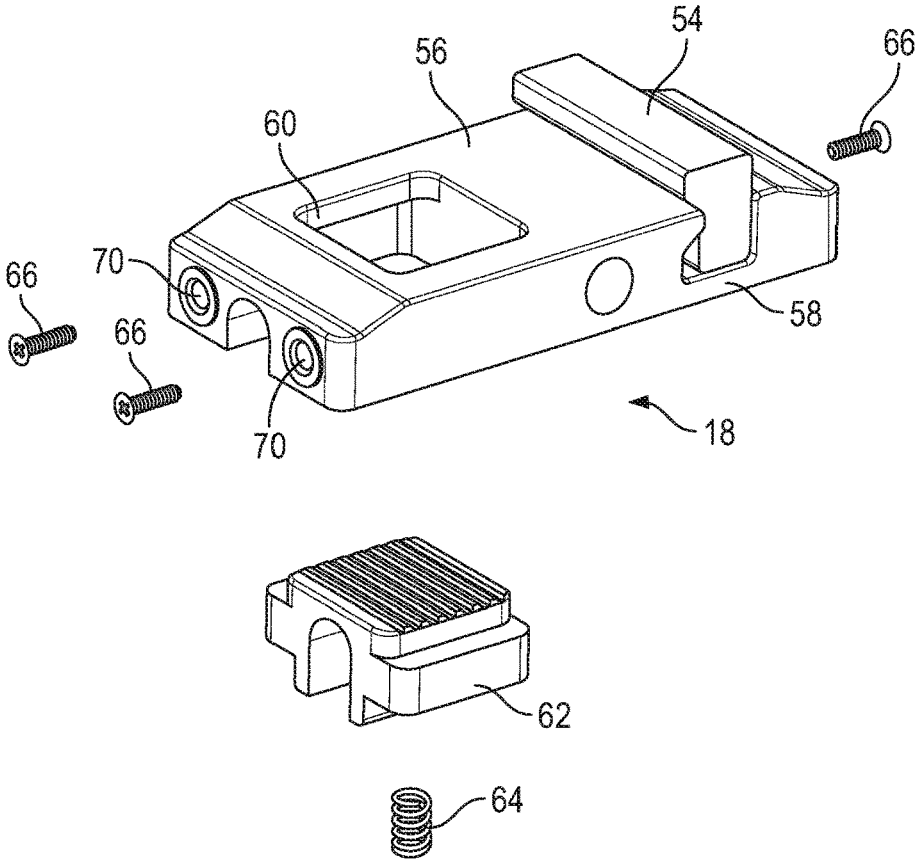
FIG. 7 is an exploded perspective of the crossbar and latch assembly.

A latch button 62 is slidably received in a recess on the underside of the body 56 and extends upwardly through the latch opening 60. A spring 64, or plurality of springs, are captured between the bottom of the latch button 62 and the housing 12 and bias position of the latch button 62 upward against the latch body 56 when assembled with the housing 12. In this regard, the latch body 56, latch button 62 and springs 64 are received into the recess 28 in the top of the housing 12 and the latch body 60 is retained in place with two retaining screws 66 at the rear and a single retaining screw 66 at the front. As best seen in FIGS. 5, 6 and 6A, the retaining screws 66 are inserted through corresponding openings 68 in the front and rear of the housing 12 during assembly and into threaded apertures 70 in the latch body. As will be described further herein, the bottom of the latch button 62 further includes a latch shoulder 112 (See FIG. 6A) which engages with a latch pin 78 on the battery door assembly 16.

Figure 8:
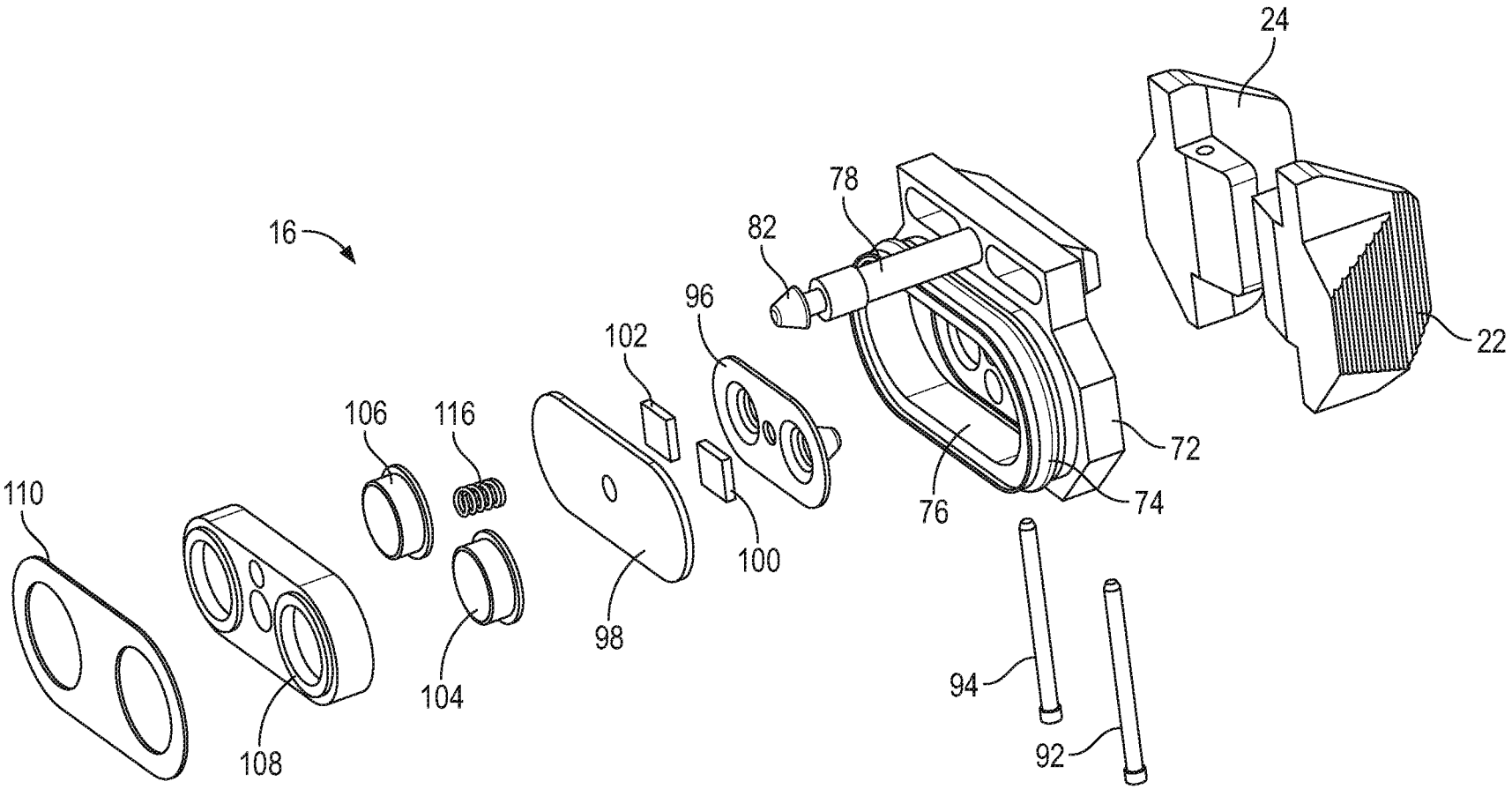
FIG. 8 is an exploded view of the battery door assembly.

Moving to FIG. 8, the battery door assembly 16 comprises a body portion 72 having a forward side and a rearward side. An O-ring gasket 74 is received around the outer periphery of a cavity wall 76 extending forwardly. When the battery door assembly 16 is assembled with the housing 12, the cavity wall 76 is received in engagement into the battery compartment opening 30 with the gasket 74 providing a waterproof seal.

A latch pin 78 is received into the top portion of forward side of the battery door body 72. The latch pin 78 has a threaded tail end 80 which is threaded into the body 72, a latch head 82 and groove 84 at the front end and a raised shoulder 86 adjacent and rearward of the groove 84. During assembly, the tail end 80 of the latch pin 78 is inserted through a guide hole 88 in the housing 12 from within the top recess 28 and threaded into a threaded bore 90 in the battery door body 72. The latch pin shaft allows the latch pin 78 (and entire battery door assembly 16) to slide inwardly and outwardly, however, the raised shoulder 86 engages with the housing 12 to retain the battery door assembly 16 with the housing 12. The latch pin 78 also allows the battery door assembly 16 to rotate about the latch 78 when it is not received within the battery opening in the rear of the housing 12. Movement of the battery door assembly 16 will be described further hereinbelow.

On the rearward side of the door assembly 16 are received the opposing L-shaped paddle actuators 22, 24 which operate about vertically oriented hinge pins 92. 94. Configuration and operation of the paddle actuators 22, 24 is described in more detail in U.S. Pat. No. 9,810,411, the entire contents of which are incorporated herein by reference.

Within the forward side cavity of the door body 72 is received an elastomeric boot 96, a circuit board 98 carrying two spaced switches 100, 102, spaced battery contacts 104, 106, an insulating spacer 108 and a signal plate 110. The elastomeric boot 96 seals openings in the door body 72 provided for the paddle actuators 22, 24 to contact the switches 100, 102.

Figure 9:
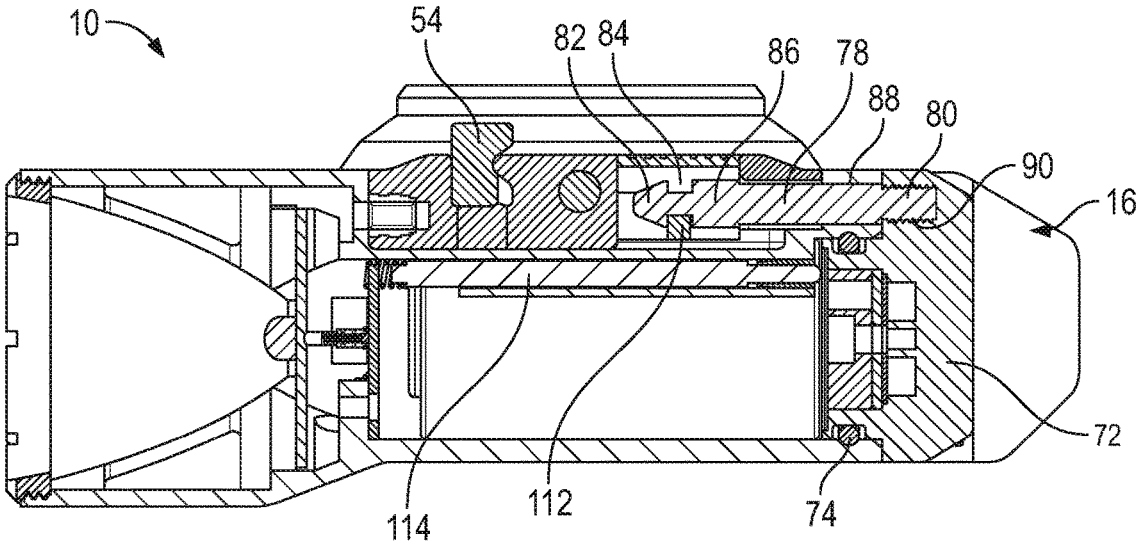
FIG. 9 is a cross-sectional view of the flashlight assembly taken along line 9-9 of FIG. 3.
Figure 10A:
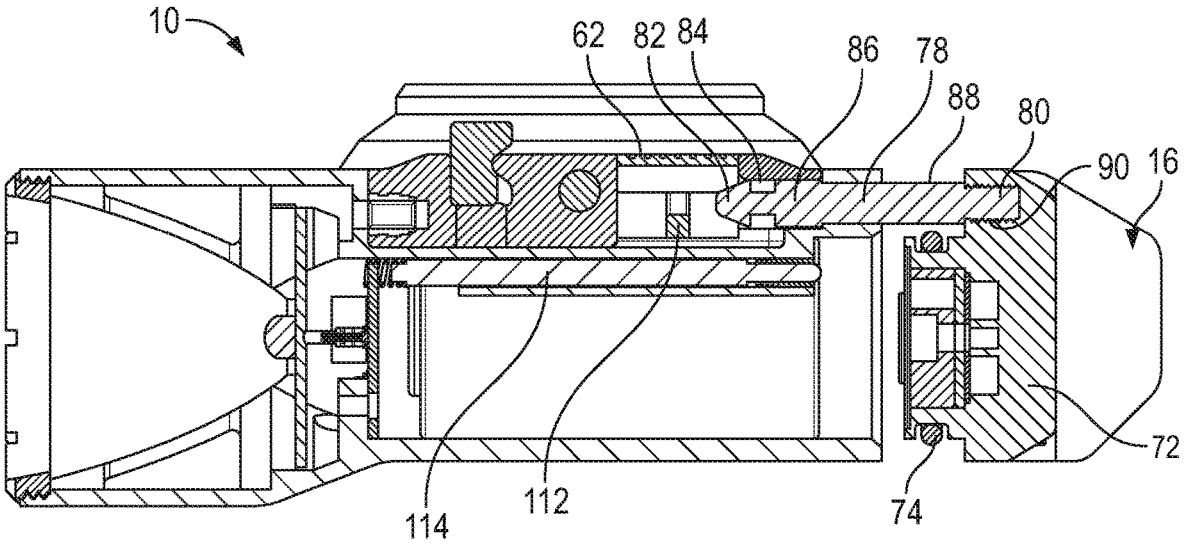
FIGS. 10A and 10B are further cross-sectional view thereof showing sequential unlatching and outward sliding of the battery door (FIG. 9A) and rotation thereof (FIG. 9B) to provide access to the battery compartment and batteries.
Figure 10B:
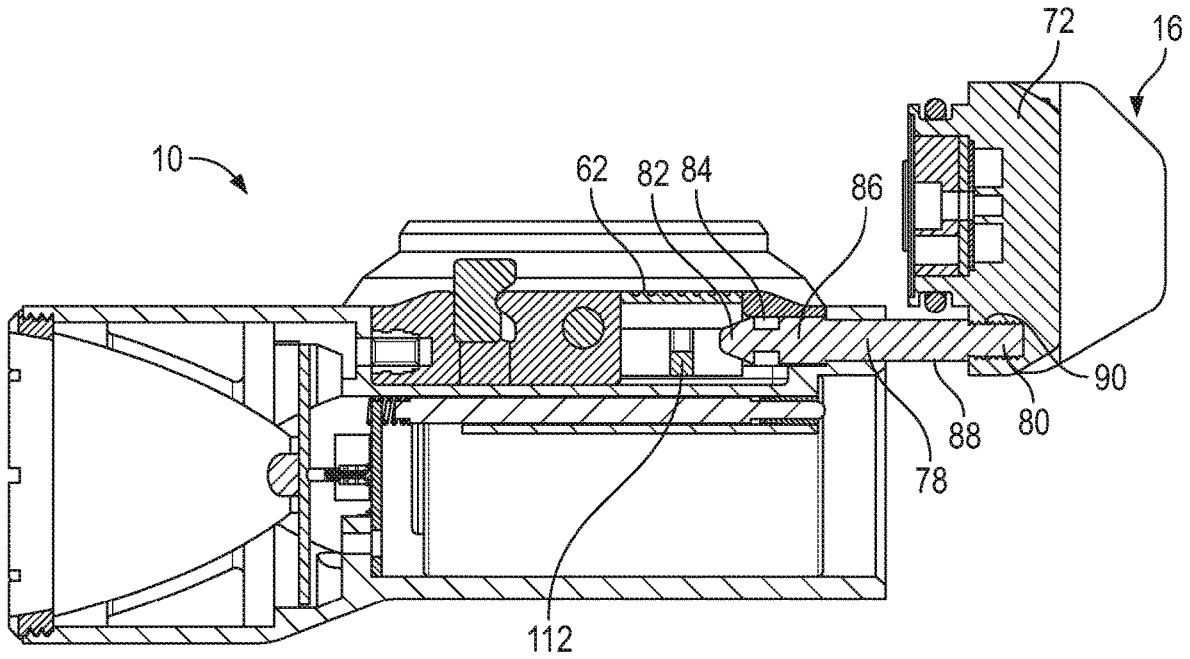

Cross-sectional FIGS. 9 and 10A, 10B illustrate the various positions of the battery door assembly 16, latch pin 78, and latch button 62. FIG. 9 depicts a cross-section of the flashlight assembly 10 fully assembled with batteries 32, 34 inserted and the battery door 16 fully latched closed. It can be seen in the upper middle portion of the illustration that the latch pin head 82 and groove 84 engage with a latch shoulder 112 on the underside of the latch button 62. The latch button 62 is configured and arranged such that when assembled, the latch pin 78 extends longitudinally through the bottom of the latch button 62 with the latch shoulder 112 extending transversely across the guide hole 88.

Figure 11:
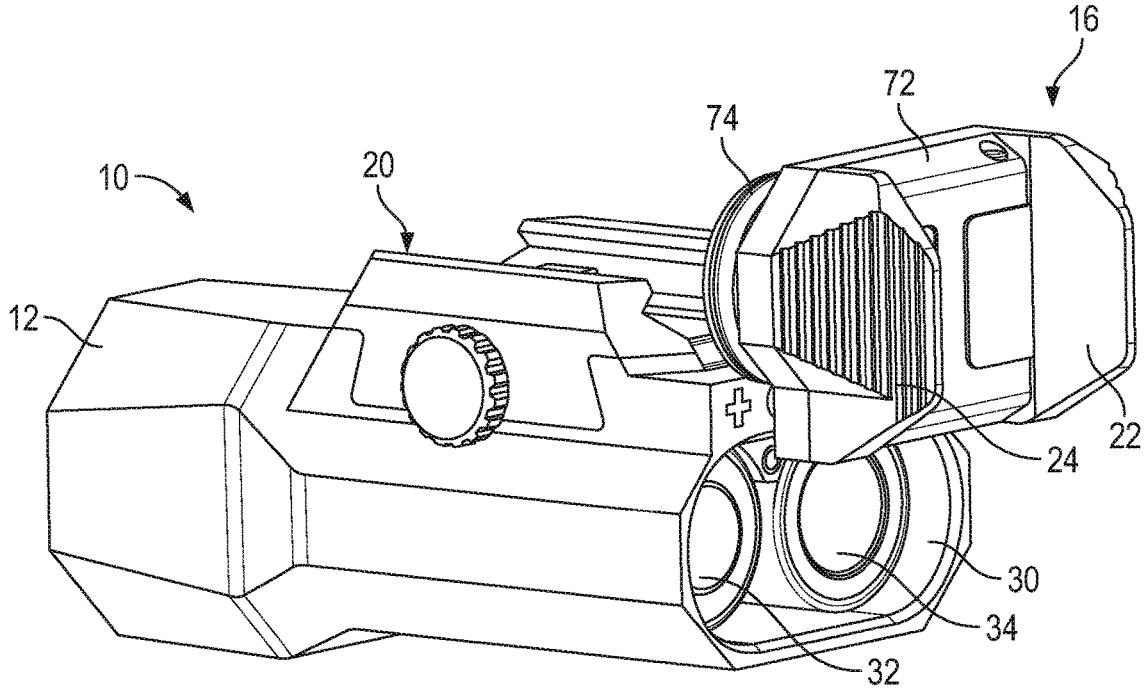
FIG. 11 is a perspective view of the flashlight assembly with the battery door assembly unlatched and rotated upwardly to expose the battery compartment.

When sliding inward, the angled side surfaces of the conical latch pin head 82 engage the latch shoulder 112 and move the latch button 62 downward against the spring bias. When fully inserted and the head 82 passes the shoulder 112, the spring biased latch shoulder 112 snaps up into the groove 84 and the rearward edge of the head 82 engages the shoulder 112 to prevent rearward movement (latched position). In this position, the battery door assembly 16 is locked in position. To release the battery door 16, the operator may press downwardly on the latch button 62 to release the latch shoulder 112 from the latch pin head 82 (actuated and unlatched) and the battery door assembly 16 may then be pulled rearwardly (FIG. 10A). As noted above, the raised shoulder 86 on the latch pin shaft prevents the door assembly 16 from being completely removed from the housing 12. To provide sufficient head space for removal/insertion of the batteries 32, 34, the door assembly 16 is rotated 180 degrees (FIG. 10B and see also FIG. 11).

Figure 12:
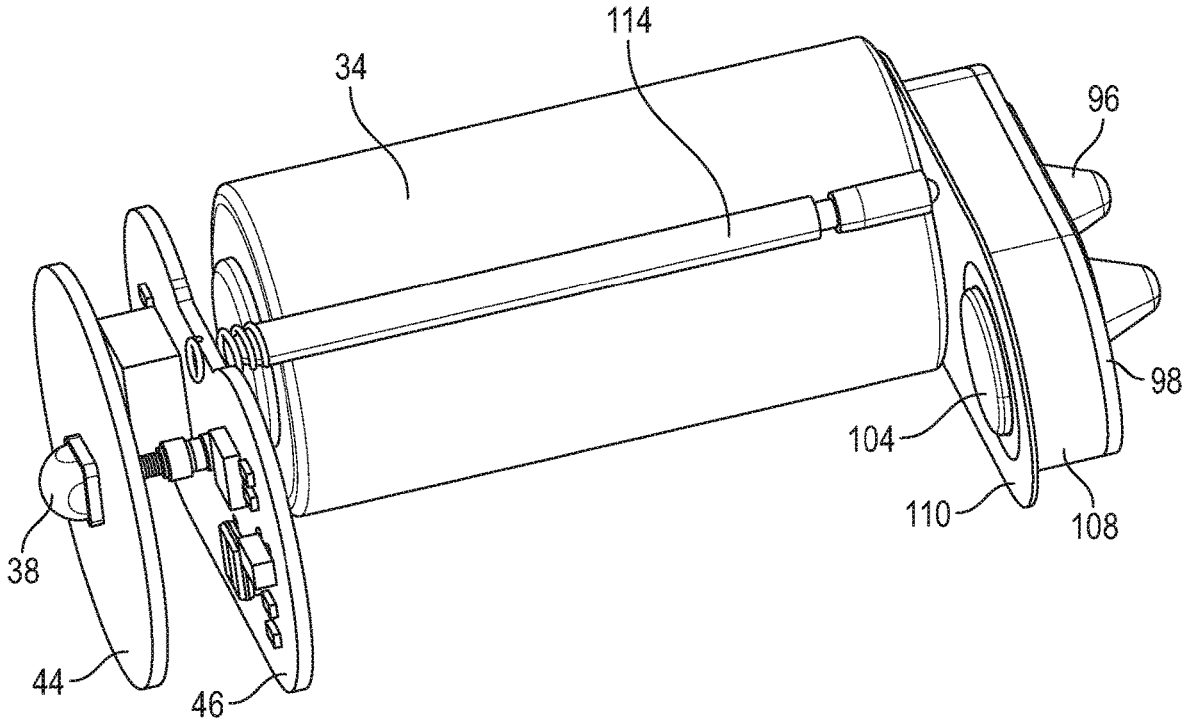
FIG. 12 is a perspective view of the internal electronic component assembly.

Finally, turning to FIG. 12, the electronic components of the flashlight 10 are illustrated without the various housing components. One battery 32 is hidden for better illustration. Electrical contact at the rear is made with the battery contacts 104, 106 mounted on the rear circuit board 98. Electrical contact at the front is made with contact pads (not shown) on the rear surface of the control circuit board 46. The creates a complete internal circuit without any power flowing through the housing 12. Control signals from the two switches 100, 102 on the rear circuit board 98 are routed to the control circuit board 46 at the front through a spring-loaded signal pin 114 extending longitudinally through the housing 12 between the batteries 32, 34. The front end of the signal pin 114 makes spring contact with a pad on the rear of the front circuit board 46, while the rear end makes spring contact with the signal plate 110 on the battery door. The signal plate 110 is electrically connected to the rear circuit board 98 with a conductive spring 116 that extends through the insulating spacer 108 (see FIG. 8).

In the exemplary embodiment, different operating modes can be controlled by actuation of either one of the switches 100, 102, or combined actuation of both switches which cause control signals of varying degree to be carried forward to the control circuit board 46. In this regard, the switches 100. 102 may be provided with different resistors (i.e. 10 ohm and 20 ohm) where each signal value triggers a different function, i.e. high power, low power, strobe, etc, and wherein actuation of both switches (for a combined resistor signal) is required to turn the flashlight on or off. This combined actuation creates a novel lockout mode which prevents inadvertently turning the flashlight on by pressing only one of the switch paddles 22, 24.

It can therefore be seen that the exemplary embodiments described herein provide a multi-functional flashlight construction that is easier to operate and maintain, and that exhibits a high degree of functional reliability even in the most rugged environment. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims

What is claimed is:

1. A flashlight assembly comprising:

a housing having a forward end and a rearward end and a battery opening in the rearward end;

a dovetail rail clamping assembly on an upper side of said housing;

a light assembly received in the forward end of the housing, a battery door assembly comprising:

a body portion having a forward side and a rearward side, the forward side being receivable within the battery opening in the housing, and a latch pin secured into a top portion of forward side of the body portion and slidably received into a longitudinal guide hole in a top portion of the rearward end of the housing, said latch pin allowing the battery door assembly to slide longitudinally relative to the housing and to rotate relative to the housing about the latch pin; and a spring biased latch button received on said upper side of said housing, said latch button including a latch configured for selective engagement with said latch pin.

2. The flashlight assembly of claim 1 further comprising an O-ring gasket received around an outer periphery of a cavity wall extending forwardly from the body portion of the battery door assembly.

3. The flashlight assembly of claim 1 wherein said latch button is slidably received in a recess on an underside of a latch body, said latch body and latch button received into a recess in the upper side of the housing.

4. The flashlight assembly of claim 3, wherein said latch body includes a transversely extending undercut groove, and said crossbar is slidably received within the undercut groove.

5. The flashlight assembly of claim 2 wherein said latch button is slidably received in a recess on an underside of a latch body, said latch body and latch button received into a recess in the upper side of the housing.

6. The flashlight assembly of claim 5, wherein said latch body includes a transversely extending undercut groove, and said crossbar is slidably received within the undercut groove.

7. The flashlight assembly of claim 1, wherein the latch pin has a latch head and groove at a front end thereof.

8. The flashlight assembly of claim 3, wherein the latch pin has a latch head and groove at a front end thereof.

9. The flashlight assembly of claim 5, wherein the latch pin has a latch head and groove at a front end thereof.

10. The flashlight assembly of claim 1, wherein the latch pin further includes a raised shoulder adjacent and rearward of the groove.

11. The flashlight assembly of claim 7, wherein the latch pin further includes a raised shoulder adjacent and rearward of the groove.

12. The flashlight assembly of claim 8, wherein the latch pin further includes a raised shoulder adjacent and rearward of the groove.

13. The flashlight assembly of claim 9, wherein the latch pin further includes a raised shoulder adjacent and rearward of the groove.

* * * * *